US011795526B2

(12) United States Patent
Yoshida et al.

(10) Patent No.: US 11,795,526 B2
(45) Date of Patent: Oct. 24, 2023

(54) SURFACE-TREATED STEEL SHEET

(71) Applicant: JFE Steel Corporation, Tokyo (JP)

(72) Inventors: Masahiro Yoshida, Tokyo (JP); Takeshi Matsuda, Tokyo (JP); Kazuhisa Okai, Tokyo (JP); Yusuke Fushiwaki, Tokyo (JP); Akira Matsuzaki, Tokyo (JP); Daisuke Mizuno, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 0 days.

(21) Appl. No.: 17/312,626

(22) PCT Filed: Nov. 13, 2019

(86) PCT No.: PCT/JP2019/044450

§ 371 (c)(1),
(2) Date: Jun. 10, 2021

(87) PCT Pub. No.: WO2020/129473

PCT Pub. Date: Jun. 25, 2020

(65) Prior Publication Data

US 2022/0112579 A1 Apr. 14, 2022

(30) Foreign Application Priority Data

Dec. 20, 2018 (JP) ..... 2018-237854

(51) Int. Cl.
*C22C 18/04* (2006.01)
*C23C 22/23* (2006.01)

(52) U.S. Cl.
CPC ..... *C22C 18/04* (2013.01); *C23C 22/23* (2013.01)

(58) Field of Classification Search
CPC ..... C22C 18/04; C23C 22/23; C23C 22/66; C23C 22/08; C23C 2/40; C23C 2/06; C23C 2/26; C23C 28/34; C23C 28/322
See application file for complete search history.

(56) References Cited

U.S. PATENT DOCUMENTS 8,962,153 B2 2/2015 Koumura et al.
2009/0011274 A1* 1/2009 Ogata ..... C09D 167/00 428/626

(Continued)

FOREIGN PATENT DOCUMENTS

CN 1394240 A 1/2003
EP 1291453 A1 3/2003

(Continued)

OTHER PUBLICATIONS

"Metal Surface Treatment Glossary", First Edition, Japan, Nikkan Kogyo Shimbun, Oct. 25, 1983, pp. 57.

(Continued)

*Primary Examiner* — Humera N. Sheikh
*Assistant Examiner* — Kevin C T Li
(74) *Attorney, Agent, or Firm* — RATNERPRESTIA

(57) ABSTRACT

A surface-treated steel sheet includes a chemical conversion coating with a thickness of 3.0 μm or less, the chemical conversion coating being placed on a surface of a hot-dip Zn—Al alloy coated steel sheet including a hot-dip Zn—Al alloy coating film containing Al: more than 1.0 mass % and 15 mass % or less, a balance being Zn and inevitable impurities. The chemical conversion coating contains $AlH_2P_3O_{10}.2H_2O$ and a compound containing one or more elements selected from Mg, Ca, and Sr such that a sum of contents of $AlH_2P_3O_{10}.2H_2O$ and the compound is 3.0 mass % to 50 mass %.

6 Claims, 1 Drawing Sheet

(56) References Cited

U.S. PATENT DOCUMENTS

| | | | | |
|---|---|---|---|---|
| 2018/0112084 | A1* | 4/2018 | Kawamura | C25D 13/22 |
| 2019/0330478 | A1* | 10/2019 | Kawamura | C09D 201/00 |

FOREIGN PATENT DOCUMENTS

| | | | | |
|---|---|---|---|---|
| EP | 3266900 | A1 | | 1/2018 |
| JP | 0647863 | A | | 2/1994 |
| JP | 09173971 | A | | 7/1997 |
| JP | 2000104154 | A | | 4/2000 |
| JP | 2002053980 | A | | 2/2002 |
| JP | 2002302776 | A | | 10/2002 |
| JP | 2003306777 | A | | 10/2003 |
| JP | 2004002950 | A | | 1/2004 |
| JP | 2005246815 | A | | 9/2005 |
| JP | 2006077077 | A | | 3/2006 |
| JP | 2006290157 | A | * | 10/2006 |
| JP | 2006290157 | A | | 10/2006 |
| JP | 2008138285 | A | | 6/2008 |
| JP | 2017121778 | A | | 7/2017 |
| TW | I592499 | B | | 7/2017 |
| WO | 2016159138 | A1 | | 10/2016 |
| WO | 2018092244 | A1 | | 5/2018 |

OTHER PUBLICATIONS

Extended European Search Report for European Application No. 19 897 735.7, dated Dec. 20, 2021, 8 pages.

Japanese Office Action for Japanese Application No. 2020-519456, dated Mar. 16, 2021, with Concise Statement of Relevance of Office Action, 9 pages.

Japanese Office Action for Japanese Application No. 2020-519456, dated Sep. 14, 2021, with Concise Statement of Relevance of Office Action, 9 pages.

Japanese Office Action for Japanese Application No. 2020-519456, dated Dec. 7, 2021, with Concise Statement of Relevance of Office Action, 7 pages.

Taiwanese Office Action with Search Report far Taiwanese Application No. 108143051, dated Jul. 15, 2020, 6 pages.

Australian Examination Report for Australian Application No. 2019402263. dated Feb. 17, 2022, 3 pages.

International Search Report and Written Opinion for International Application No. PCT/JP2019/044450, dated Feb. 25, 2020, 8 pages.

Morimoto et al., Excellent Corrosion-resistant Zn—Al—Mg—Si Alloy Hot-dip Galvanized Steel Sheet "Super DYMA", Nippon Steel Technical Report, 2002, No. 377, pp. 22-24, with English Abstract.

Chinese Office Action for Chinese Application No. 201980083925.8, dated Apr. 28, 2022 with Concise Statement of Relevance of Office Action, 10 pages.

Australian Examination Report for Australian Application No. 2019402263, dated Aug. 9, 2022, 3 pages.

Korean Office Action for Korean Application No. 10-2021-7018241, dated Sep. 25, 2022 with Concise Statement of Relevance of Office Action, 6 pages.

Chinese Office Action for Chinese Application No. 201980083925.8, dated Oct. 31, 2022 with Concise Statement of Relevance of Office Action, 6 pages.

Korean Office Action for Korean Application No. 10-2021-7018241, dated Mar. 13, 2023 with Concise Statement of Relevance of Office Action, 5 pages.

Chinese Office Action for Chinese Application No. 201980083925.8, dated May 24, 2023 with Concise Statement of Relevance of Office Action, 6 pages.

* cited by examiner

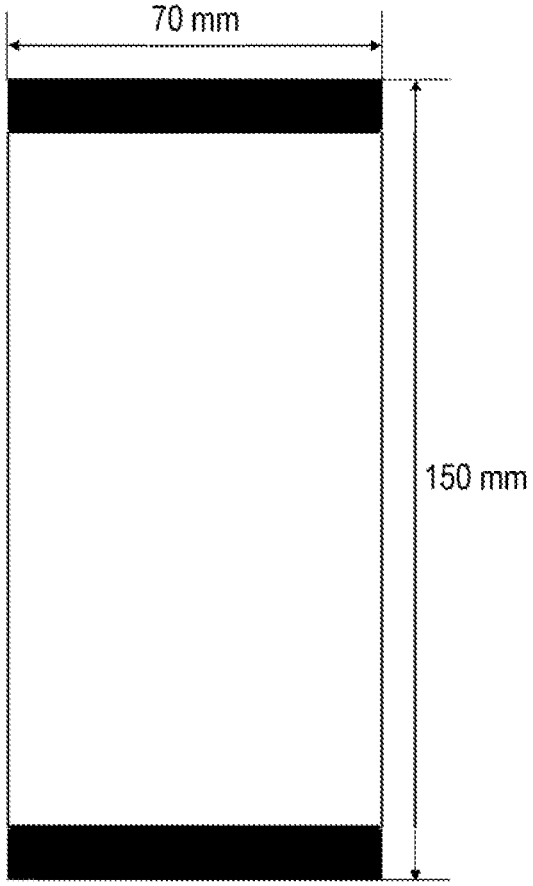
70 mm
150 mm

SURFACE-TREATED STEEL SHEET

CROSS REFERENCE TO RELATED APPLICATIONS

This is the U.S. National Phase application of PCT/JP2019/044450, filed Nov. 13, 2019, which claims priority to Japanese Patent Application No. 2018-237854, filed Dec. 20, 2018, the disclosures of these applications being incorporated herein by reference in their entireties for all purposes.

FIELD OF THE INVENTION

The present invention relates to surface-treated steel sheets used in fields such as electric machines and building materials. Aspects of the present invention particularly relate to a surface-treated steel sheet with excellent worked part corrosion resistance (end part corrosion resistance).

BACKGROUND OF THE INVENTION

A hot-dip Zn—Al alloy coated steel sheet including a coated layer containing Al: 1 mass % to 15 mass % has more excellent corrosion resistance as compared to hot-dip Zn coated steel sheets and is, therefore, widely used mainly in the field of electric machines and building materials. In a hot-dip Zn—Al alloy coated steel sheet having an Al content of more than 15 mass %, an alloy layer at a base steel-coating interface is thick and has reduced adhesion properties. Therefore, a hot-dip Zn—Al alloy coated steel sheet containing Al: 1 mass % to 15 mass % is widely used. As a typical hot-dip Zn—Al alloy coated steel sheet, Galfan (GF) containing Al: about 5 mass % has been produced since the 1980s and has been often used. However, recently, a highly functional hot-dip Zn—Al alloy coated steel sheet including a coating containing an element such as Mg has been developed and has been used.

Examples of such a highly functional hot-dip Zn—Al alloy coated steel sheet include a hot-dip Zn—Al alloy coated steel sheet including a coated layer which contains Al: 1.0 mass % to 10 mass % and Mg: 0.2 mass % to 1 mass % such that the occurrence of coarse spangles which are problematic in Galfan is suppressed (for example, Patent Literature 1) and a hot-dip Zn—Al alloy coated steel sheet including a coated layer which contains Al: 2 mass % to 19 mass % and Mg: 1 mass % to 10 mass % such that the corrosion resistance is further enhanced (for example, Patent Literature 2).

Furthermore, in the field of electric machines and building materials, hot-dip Zn—Al alloy coated steel sheets are often used without painting. Therefore, a surface-treated steel sheet including a chemical conversion coating formed on a surface of a hot-dip Zn—Al alloy coating has been developed for the purpose of further enhancing the blackening resistance, the corrosion resistance, and the like and is used.

Many chemical conversion techniques for hot-dip Zn—Al alloy coated steel sheets have been developed. In recent years, chromate-free chemical conversion techniques in which hexavalent chromium, which is a pollution control substance, is not used have been developed with consideration for the environment. There are, for example, titanium- and zirconium-based chemical conversion techniques (for example, Patent Literature 3 and 4) and a phosphoric acid-based chemical conversion technique (for example, Patent Literature 5).

Furthermore, the following sheet has been developed: a surface-treated steel sheet which includes a metal sheet coated with a water-based resin containing oxide particles and an anti-rust additive in combination and which has excellent adhesion to paint films and excellent weldability (Patent Literature 6).

PATENT LITERATURE

PTL 1: Japanese Unexamined Patent Application Publication No. 2008-138285

PTL 2: Japanese Unexamined Patent Application Publication No. 2000-104154

PTL 3: Japanese Unexamined Patent Application Publication No. 2003-306777

PTL 4: Japanese Unexamined Patent Application Publication No. 2004-2950

PTL 5: Japanese Unexamined Patent Application Publication No. 2002-302776

PTL 6: International Publication No. 2016-159138

SUMMARY OF THE INVENTION

In a case where hot-dip Zn—Al alloy coated steel sheets are used in the field of electric machines and building materials, worked part corrosion resistance, particularly end part corrosion resistance, is a problem. After a hot-dip Zn—Al alloy coated steel sheet is generally coated and is subjected to a chemical conversion treatment as required, the hot-dip Zn—Al alloy coated steel sheet is supplied to a manufacturer in the form of a coil or sheet, is sheared to a necessary size, and is then worked into a target shape. Therefore, an uncoated end surface of the steel sheet is inevitably exposed at a sheared part and iron (Fe) and metal (Zn, Al, Mg, or the like) contained in a coating film in the vicinity form a local cell, so that corrosion originating from an end part proceeds. Similarly, in a case where cracks are caused in a coating film by severe working such as 180° bending and a base steel or an interface alloy layer is exposed, iron (Fe) or an interface alloy layer (an Fe—Al alloy) forms a local cell together with metal (Zn, Al, Mg, or the like) contained in a coating film in the vicinity, so that corrosion originating from the cracks proceeds.

In Patent Literature 1 and 2, worked part corrosion resistance, particularly end part corrosion resistance, is not investigated.

In a case where a hot-dip Zn—Al alloy coated steel sheet subjected to a titanium- or zirconium-based chemical conversion treatment as described in Patent Literature 3 or 4 is used, worked part corrosion resistance, particularly end part corrosion resistance, cannot be fully improved.

A surface-treated steel sheet described in Patent Literature 5 is improved in worked part corrosion resistance in such a manner that a chemical conversion coating containing a phosphate is formed on a hot-dip Zn—Al alloy coating. However, even if the surface-treated steel sheet described in Patent Literature 5 is used, worked part corrosion resistance, particularly end part corrosion resistance, cannot be fully improved.

Furthermore, in a case where the hot-dip Zn—Al alloy coated steel sheet covered with the water-based resin, which contains the oxide particles and the anti-rust additive in combination, as described in Patent Literature 6 is used, the composition of a coating film, the oxide particles, and the anti-rust additive are not specifically identified and worked part corrosion resistance, particularly end part corrosion resistance, cannot necessarily be fully improved.

Aspects of the present invention have been made in view of the above circumstances and have an object to provide a surface-treated steel sheet having coating adhesion properties and excellent worked part corrosion resistance, particularly excellent end part corrosion resistance.

The inventors have performed investigations to solve the above problem and, as a result, have found that unprecedented excellent worked part corrosion resistance, particularly excellent end part corrosion resistance, can be achieved in such a manner that a chemical conversion coating containing $AlH_2P_3O_{10}$ and a compound containing one or more elements selected from Mg, Ca, and Sr is further formed on a surface of a hot-dip Zn—Al alloy coating film, formed on a surface of a steel sheet, having a specific composition.

Aspects of the present invention have been made on the basis of the above finding and a summary thereof is provided below.

[1] A surface-treated steel sheet includes a chemical conversion coating with a thickness of 3.0 μm or less, the chemical conversion coating being placed on a surface of a hot-dip Zn—Al alloy coated steel sheet including a hot-dip Zn—Al alloy coating film containing Al: more than 1.0 mass % and 15 mass % or less, a balance being Zn and inevitable impurities. The chemical conversion coating contains $AlH_2P_3O_{10}.2H_2O$ and a compound containing one or more elements selected from Mg, Ca, and Sr such that a sum of contents of $AlH_2P_3O_{10}.2H_2O$ and the compound is 3.0 mass % to 50 mass %.

[2] In the surface-treated steel sheet specified in Item [1], the compound containing one or more elements selected from Mg, Ca, and Sr is one or more oxides selected from MgO, $MgAl_2O_4$, CaO, and SrO.

[3] In the surface-treated steel sheet specified in Item [1] or [2], the chemical conversion coating further contains $SiO_2$ and a sum of contents of the $SiO_2$; the compound containing one or more elements selected from Mg, Ca, and Sr; and the $AlH_2P_3O_{10}.2H_2O$ is 3.0 mass % to 50 mass %.

[4] In the surface-treated steel sheet specified in any one of Items [1] to [3], the hot-dip Zn—Al alloy coating film further contains Mg: 0.1 mass % to 10 mass %.

[5] In the surface-treated steel sheet specified in any one of Items [1] to [4], the hot-dip Zn—Al alloy coating film further contains one or more elements selected from Si, Ca, Ti, Cr, and Ni such that a sum of contents of the elements is 0.01 mass % to 1.0 mass %.

According to aspects of the present invention, a surface-treated steel sheet excellent in worked part corrosion resistance, particularly end part corrosion resistance, is obtained. Using a surface-treated steel sheet according to aspects of the present invention in the field of electric machines and building materials enables the product life of home appliances and the life of buildings to be extended.

BRIEF DESCRIPTION OF THE DRAWING

The FIGURE is a schematic view of a sample for evaluating end surface corrosion resistance.

DETAILED DESCRIPTION OF EMBODIMENTS OF THE INVENTION

Aspects of the present invention include a chemical conversion coating with a thickness of 3.0 μm or less, the chemical conversion coating being placed on a surface of a hot-dip Zn—Al alloy coated steel sheet including a hot-dip Zn—Al alloy coating film containing Al: more than 1.0 mass % and 15 mass % or less, the balance being Zn and inevitable impurities. The chemical conversion coating contains $AlH_2P_3O_{10}.2H_2O$ and a compound containing one or more elements selected from Mg, Ca, and Sr such that the sum of the contents of $AlH_2P_3O_{10}.2H_2O$ and the compound is 3.0 mass % to 50 mass %.

First, a coating film of the hot-dip Zn—Al alloy coated steel sheet, which serves as a base, the coating film being a component of the surface-treated steel sheet according to aspects of the present invention, is described. The coating film used is a hot-dip Zn—Al alloy coating film containing Al: more than 1.0 mass % and 15 mass % or less.

Since the hot-dip Zn—Al alloy coating film contains Al: more than 1.0 mass % and 15 mass % or less, the effect of enhancing the corrosion resistance is obtained. When the content of Al is 1.0 mass % or less, the effect of enhancing the corrosion resistance is not fully obtained. However, when the Al content is more than 15 mass %, the effect of enhancing the corrosion resistance is saturated and an Fe—Al alloy layer grows significantly at a base steel-coating interface to reduce coating adhesion properties. In order to stably obtain excellent coating adhesion properties, the Al content is preferably 11 mass % or less.

The hot-dip Zn—Al alloy coating film forms a stable corrosion product during corrosion as described above. As a result, the hot-dip Zn—Al alloy coating film has more excellent corrosion resistance as compared to surface-treated steel sheets including a coating film having an Al content of 1.0 mass % or less.

The hot-dip Zn—Al alloy coating film preferably further contains Mg: 0.1 mass % to 10 mass %. Containing Mg: 0.1 mass % to 10 mass % allows the effect of stabilizing a corrosion product to significantly enhance the corrosion resistance to be obtained when a coated steel sheet corrodes. When the content of Mg is less than 0.1 mass %, the effect of enhancing the corrosion resistance is not fully obtained. When the Mg content is more than 10 mass %, the effect of enhancing the corrosion resistance is saturated, oxide dross containing Mg is likely to be generated, and the appearance deteriorates because of the occurrence of dross defects due to the adhesion of granular dross. The Mg content is preferably 1.0 mass % or more and is preferably 5.0 mass % or less.

The hot-dip Zn—Al alloy coating film preferably further contains one or more elements selected from Si, Ca, Ti, Cr, and Ni such that the sum of the contents of the elements is 0.01 mass % to 1.0 mass %. When the hot-dip Zn—Al alloy coating film contains these elements alone or in combination, an effect below can be obtained in the hot-dip Zn—Al alloy coated steel sheet.

Si, Cr, and/or Ni is mainly contained in an interfacial alloy layer formed at the base steel-coating interface of a coated steel sheet. Hot-dip Zn—Al alloy coated steel sheets provided with such an interfacial alloy layer have enhanced coating adhesion properties. Hot-dip Zn—Al alloy coated steel sheets including a coating film containing Ca have enhanced coating appearance. In addition, Ti precipitates in the form of $TiAl_3$, which functions as a precipitation nucleus for an α-Al phase, to suppress the formation of a coarse α-Al phase in a coating film composition in which the α-Al phase mainly precipitates in the form of proeutectic. As a result, uneven corrosion is suppressed and the corrosion resistance of a hot-dip Zn—Al alloy coated steel sheet is enhanced.

When the sum of the contents of one or more elements selected from Si, Ca, Ti, Cr, and Ni is less than 0.01%, the effect of enhancing each of the above-mentioned functions does not develop. However, when the sum of the contents is more than 1.0 mass %, each effect is saturated and the appearance quality of a coating film is impaired by the adhesion of dross generated in a large amount. As a result, the corrosion resistance of the surface-treated steel sheet deteriorates in some cases. Thus, when one or more elements selected from Si, Ca, Ti, Cr, and Ni are contained, the sum of the contents thereof is 0.01 mass % to 1.0 mass % or less. The sum of the contents thereof is more preferably 0.05 mass % or more and is more preferably 0.5 mass % or less.

The balance is Zn and inevitable impurities.

Since the composition of the above-mentioned hot-dip Zn—Al alloy coating film is substantially the same as the composition of a coating bath, the composition of the hot-dip Zn—Al alloy coating film can be adjusted by controlling the composition of the coating bath.

In order to obtain sacrificial protection ability sufficient for steel sheets, the coating weight of the hot-dip Zn—Al alloy coating film is preferably 30 $g/m^2$ or more (coating weight per side). However, when the coating weight is large, exfoliation occurs in some cases on the occasion of performing heavy working such as 180° bending. Therefore, the coating weight is preferably 200 $g/m^2$ or less (coating weight per side).

Next, the chemical conversion coating, which is most important in accordance with aspects of the present invention, is described.

In the surface-treated steel sheet according to aspects of the present invention, the thickness of the chemical conversion coating is 3.0 μm or less. When the thickness is more than 3.0 μm, a problem that the chemical conversion coating powders in working occurs and manufacturing costs are high. On the other hand, the lower limit of the thickness is not particularly limited and is preferably 0.1 μm or more in order to stably obtain an effect of the chemical conversion coating. The thickness is preferably 0.5 μm or more and is preferably 1.0 μm or less.

Next, the chemical conversion coating of the surface-treated steel sheet according to aspects of the present invention contains $AlH_2P_3O_{10}.2H_2O$ and the compound containing one or more elements selected from Mg, Ca, and Sr such that the sum of the contents of $AlH_2P_3O_{10}.2H_2O$ and the compound is 3.0 mass % to 50 mass %.

Since the chemical conversion coating contains $AlH_2P_3O_{10}.2H_2O$, when the worked part corrodes, $P_3O_{10}^{5-}$ dissolved from the chemical conversion coating chelates $Al^{3+}$, $Zn^{2+}$, $Fe^{2+}$, and $Fe^{3+}$ dissolved from the hot-dip Zn—Al alloy coated steel sheet, which is a base, to form a passivation film. As a result, the effect of reducing the corrosion rate of a base steel sheet develops.

Furthermore, when the chemical conversion coating contains a Mg-containing compound (Mg compound) and $AlH_2P_3O_{10}.2H_2O$ in combination, the pH-buffering action works during corrosion to stabilize the pH of a corroded part to about 10, at which the dissolution rate of Al and Zn is low, whereby the dissolution rate of the hot-dip Zn—Al alloy coating film is reduced.

When one or more selected from a Ca-containing compound (Ca compound) and a Sr-containing compound (Sr compound) are contained in the chemical conversion coating instead of or together with the Mg compound in combination with $AlH_2P_3O_{10}.2H_2O$, a corrosion inhibition effect generated during corrosion is high. Although the mechanism of this phenomenon is not necessarily clear, it is conceivable that $Ca^{2+}$ and $Sr^{2+}$ are dissolved from a compound containing one or more elements selected from Ca and Sr during corrosion; stable corrosion products containing them are formed; and, as a result, the effect of suppressing the progress of subsequent corrosion develops.

Thus, since the chemical conversion coating contains $AlH_2P_3O_{10}$ and the compound containing one or more elements selected from Mg, Ca, and Sr, the formation of the passivation film and/or the development of the pH-buffering action occurs during corrosion and the corrosion rate of the obtained hot-dip Zn—Al alloy coated steel sheet can be reduced.

As described above, the surface-treated steel sheet according to aspects of the present invention includes the hot-dip Zn—Al alloy coated steel sheet, which includes the hot-dip Zn—Al alloy coating film containing Al: more than 1.0 mass % and 15 mass % or less, the balance being Zn and inevitable impurities. The hot-dip Zn—Al alloy coated steel sheet forms the stable corrosion product during corrosion. As a result, the corrosion resistance is excellent as compared to a coating film which serves as a base of a surface-treated steel sheet and which has an Al content of 1.0 mass % or less.

Furthermore, in the surface-treated steel sheet according to aspects of the present invention, using the hot-dip Zn—Al alloy coated steel sheet, which contains the compound containing one or more elements selected from Mg, Ca, and Sr, as a base allows Mg, Ca, or Sr to be dissolved from a coating film during corrosion. Therefore, the effect of reducing the corrosion rate in the presence of $AlH_2P_3O_{10}.2H_2O$, as well as an effect due to the Mg compound, the Ca compound, or the Sr compound, which is contained in the chemical conversion coating, can be generated. However, the effect due to the Mg compound, the Ca compound, or the Sr compound in the chemical conversion coating contributes more significantly to the corrosion resistance than an effect due to Mg, Ca, or Sr in the coating film. Thus, it is essential that the chemical conversion coating contains the compound containing one or more elements selected from Mg, Ca, and Sr.

When the sum of the contents of $AlH_2P_3O_{10}.2H_2O$ and the compound containing one or more elements selected from Mg, Ca, and Sr is less than 3.0 mass %, the effect of improving the corrosion resistance is not fully obtained. However, when the sum of the contents is more than 50 mass %, the effect of improving the corrosion resistance is saturated and the amount of resin serving as a binder relatively decreases to embrittle the coating. Thus, the sum of the contents of $AlH_2P_3O_{10}.2H_2O$ and the compound containing one or more elements selected from Mg, Ca, and Sr is 3.0 mass % to 50 mass %. The sum of the contents is preferably 5.0 mass % or more and is preferably 30 mass % or less.

The Mg compound, the Ca compound, and the Sr compound are not particularly limited as long as they can generate the effect of reducing the corrosion rate; and may be, for example, oxides, nitrates, sulfates, or intermetallic compounds. In accordance with aspects of the present invention, the Mg compound is preferably one or more oxides selected from MgO or $MgAl_2O_4$. These oxides are stable, are inexpensive, and are therefore preferable. Examples of the Ca compound include CaO, $CaCO_3$, $Ca(OH)_2$, $Ca(NO_3)_2.4H_2O$, $CaSO_4.2H_2O$, and the like. Examples of the Sr compound include, but are not limited to, SrO and the like. In accordance with aspects of the present invention, one or more oxides selected from MgO, $MgAl_2O_4$, CaO, and SrO are preferably used from the viewpoint that the effect of reducing the corrosion rate is higher.

In accordance with aspects of the present invention, the chemical conversion coating preferably further contains $SiO_2$. When the chemical conversion coating contains $SiO_2$, $SiO_2$ may be contained such that the sum of the contents of $SiO_2$; the compound containing one or more elements selected from Mg, Ca, and Sr; and $AlH_2P_3O_{10}.2H_2O$ is 3.0 mass % to 50 mass %. Containing $SiO_2$ enables the corrosion resistance of the hot-dip Zn—Al alloy coated steel sheet to be enhanced.

Resin is used as a binder in the chemical conversion coating. The resin used is not particularly limited and may be an epoxy resin, a urethane resin, an acrylic resin, an acrylic silicon resin, an alkyd resin, a polyester resin, an ethylene resin, a fluorocarbon resin, or the like. In particular, an organic polymer resin containing an OH group and/or a COOH group is preferably used from the viewpoint of corrosion resistance.

Examples of the organic polymer resin containing the OH group and/or the COOH group include epoxy resins, acrylic copolymer resins, ethylene-acrylic acid copolymer resins, alkyd resins, polybutadiene resins, phenol resins, polyurethane resins, polyamine resins, phenylene resins, mixtures of two or more of these resins, addition polymers, and the like.

The epoxy resin used may be an epoxy resin prepared by the glycidyl etherification of bisphenol A, bisphenol F, novolac, or the like; an epoxy resin prepared by the glycidyl etherification of an adduct of bisphenol A with polyphenylene oxide, ethylene oxide, or polyalkylene glycol; an aliphatic epoxy resin; an alicyclic epoxy resin; a polyether epoxy resin; or the like.

Examples of the urethane resin include oil-modified polyurethane resins, alkyd polyurethane resins, polyester polyurethane resins, polyether urethane resins, polycarbonate polyurethane resins, and the like.

Examples of the acrylic resin include polyacrylic acids, copolymers thereof, polyacrylates, copolymers thereof, polymethacrylic acids, copolymers thereof, polymethacrylates, copolymers thereof, urethane-acrylic acid copolymers (or urethane modified-acrylic resins), styrene-acrylic acid copolymers, and the like. Furthermore, resins prepared by modifying these resins with another alkyd resin, epoxy resin, phenol resin, or the like may be used.

Examples of the acrylic silicon resin include those obtained by adding curing agents to acrylic copolymers which serve as a base resin and which have a side chain or terminal containing a hydrolyzable alkoxysilyl group. In a case where the acrylic silicon resin is used, excellent weather resistance can be expected.

Examples of the alkyd resin include oil-modified alkyd resins, rosin-modified alkyd resins, phenol-modified alkyd resins, styrenated alkyd resins, silicon-modified alkyd resins, acrylic-modified alkyd resins, oil-free alkyd resins, high-molecular weight oil-free alkyd resins, and the like.

Examples of the ethylene resin include ethylenic copolymers such as ethylene-acrylic acid copolymers, ethylene-methacrylic acid copolymers, and carboxyl-modified polyolefin resins; ethylene-unsaturated carboxylic acid copolymers; ethylenic ionomers; and the like. Furthermore, resins obtained by modifying these resins with another alkyd resin, epoxy resin, phenol resin, or the like may be used.

The fluorocarbon resin is a fluoroolefinic copolymer. Examples of this include copolymers prepared by copolymerizing a fluoroolefinic monomer (fluoroolefin) with monomers such as alkyl vinyl ethers, cycloalkyl vinyl ethers, carboxylic acid-modified vinyl esters, hydroxyalkyl allyl ethers, tetrafluoropropyl vinyl ethers, and the like. In a case where the fluorocarbon resin is used, excellent weather resistance and excellent hydrophobicity can be expected.

The above organic resins can be used alone or in combination of two or more of them.

Furthermore, a thermosetting resin is particularly preferably used for the purpose of enhancing the corrosion resistance and the workability. In this case, an amino resin such as a urea resin (butylated urea resin or the like), a melamine resin (butylated melamine resin), a butylated urea-melamine resin, or a benzoguanamine resin; a curing agent such as a blocked isocyanate, an oxazoline compound, or a phenol resin; or the like may be blended.

In accordance with aspects of the present invention, the type of a base steel sheet for the hot-dip Zn—Al alloy coating film is not particularly limited. For example, a hot-rolled steel sheet or steel strip descaled by pickling, a cold-rolled steel sheet or steel strip obtained by cold-rolling the hot-rolled steel sheet or steel strip, or the like can be used.

Next, a method for manufacturing the surface-treated steel sheet according to aspects of the present invention is described.

A steel sheet used as a base steel sheet need not be particularly limited and may be appropriately selected from known steel sheets depending on applications. For example, the hot-rolled steel sheet or steel strip descaled by pickling, the cold-rolled steel sheet or steel strip obtained by cold-rolling the hot-rolled steel sheet or steel strip, or the like can be used as described above. After hot-dip coating (hot dipping) is performed by dipping the steel sheet (base steel sheet) in a hot-dip Zn—Al alloy coating bath, the steel sheet is pulled out of the coating bath and is cooled such that a hot-dip Zn—Al alloy coated layer is formed on a surface of the steel sheet, whereby the hot-dip Zn—Al alloy coated steel sheet is obtained. Since the composition of the above-mentioned hot-dip Zn—Al alloy coating film is substantially the same as the composition of the coating bath as described above, the composition of the hot-dip Zn—Al alloy coating film can be adjusted by controlling the composition of the coating bath.

The hot-dip Zn—Al alloy coating bath (hereinafter simply referred to as the coating bath in some cases), which is used in the manufacturing method according to aspects of the present invention, has a bath composition which mainly contains Zn and also contains Al of more than 1.0 mass % and 15 mass % or less. Al in the coating bath has the effect of enhancing the corrosion resistance of the hot-dip Zn—Al alloy coated steel sheet and the effect of suppressing the generation of dross when the coating bath further contains Mg. When the content of Al is 1.0 mass % or less, the effect of enhancing the corrosion resistance is not sufficient and the effect of suppressing the generation of oxide dross containing Mg is low. However, when the Al content is more than 15 mass %, the effect of enhancing the corrosion resistance is saturated and an Fe—Al alloy layer grows significantly at a base steel-coating interface to reduce coating adhesion properties. In order to stably obtain excellent coating adhesion properties, the Al content is preferably 11 mass % or less.

The coating bath may further contain Mg: 0.1 mass % to 10 mass % or less as required. The addition of Mg is preferable from the viewpoint of corrosion resistance. Mg has the effect of stabilizing a corrosion product to significantly enhance the corrosion resistance when the hot-dip Zn—Al alloy coated steel sheet corrodes. When the content of Mg is more than 10 mass %, the effect of enhancing the corrosion resistance is almost saturated. In a case where Mg is contained in the coating bath, when the Mg content is less than 0.1 mass %, the effect of enhancing the corrosion resistance is not fully obtained. Thus, the Mg content is preferably 0.1 mass % to 10 mass %.

When Mg is contained in the coating bath, the mass ratio of the Mg content [Mg] to Al content [Al] of the coating bath is preferably [Mg]/[Al]≤5 and more preferably [Mg]/[Al]≤1. When [Mg]/[Al]>5, the effect of suppressing the generation of dross (oxide dross containing Mg) by Al is low; hence, dross defects due to the adhesion of granular dross are likely to occur and the appearance of the steel sheet is likely to deteriorate. That is, when [Mg]/[Al]≤5, the occurrence of the dross defects can be suppressed. When [Mg]/[Al]≤1, the occurrence of the dross defects can be more stably suppressed.

The coating bath may further contain one or more elements selected from Si, Ca, Ti, Cr, and Ni such that the sum of the contents of the elements is 0.01 mass % to 1.0 mass % as required.

When the coating bath contains Si, Cr, and/or Ni, an interfacial alloy layer containing Si, Cr, and/or Ni is formed at the base steel-coating interface of the hot-dip Zn—Al alloy coated steel sheet and therefore coating adhesion properties are enhanced. In particular, an interfacial alloy layer containing Ni is formed with an acicular shape in a thickness direction of a coating and therefore generates an anchoring effect to enhance the adhesion to a coating upper layer. When the coating bath contains Ca, the formation of oxide dross mainly containing Mg oxides is suppressed and the number of surface defects due to the adhesion of dross decreases, resulting in the enhancement of coating appearance. Adding Ti into the coating bath precipitates $TiAl_3$ in the form of proeutectic, so that $TiAl_3$ functions as a precipitation nucleus for an α-Al phase in a coating system in which the α-Al phase precipitates naturally in the form of proeutectic. As a result, the formation of a coarse α-Al phase causing uneven corrosion can be suppressed. When the sum of the contents of one or more elements selected from Si, Ca, Ti, Cr, and Ni is less than 0.01 mass %, the above-mentioned effects are not fully obtained. However, when the sum of the contents is more than 1.0 mass %, each effect is saturated and appearance quality is impaired by the adhesion of dross generated in a large amount in some cases. Thus, when one or more elements selected from Si, Ca, Ti, Cr, and Ni are contained in the coating bath, the sum of the contents thereof is 0.01 mass % to 1.0 mass %. Furthermore, Si, Ca, Ti, Cr, or Ni is preferably contained alone from the viewpoint of adjusting and controlling a component of the coating bath.

The cooling rate of the coated steel sheet pulled out of the hot-dip Zn—Al coating bath is not particularly limited and is preferably 5° C./s to 30° C./s.

The temperature of the coating bath is preferably 40° C. to 60° C. higher than the solidification start temperature of the coating bath.

Next, the chemical conversion coating is formed on a surface of the obtained hot-dip Zn—Al alloy coated steel sheet. The chemical conversion coating is formed in such a manner that the obtained hot-dip Zn—Al alloy coated steel sheet is treated with a chemical conversion solution for forming the chemical conversion coating according to aspects of the present invention by, for example, an application method, a dipping method, a spraying method, or the like, followed by heat drying. The chemical conversion solution contains $AlH_2P_3O_{10}.2H_2O$ and the compound containing one or more elements selected from Mg, Ca, and Sr and a solvent. The solvent may be either an aqueous solvent or an organic solvent.

A method for applying the chemical conversion solution may be a method using a roll coater (a three-roll system, a two-roll system, or the like), a squeeze coater, or the like. After an application treatment using a squeeze coater or the like, a dipping treatment, or a spraying treatment is performed, the adjustment of the amount of application, the homogenization of appearance, and/or the equalization of thickness may be performed by an air knife method or a squeeze roll method.

Means used for heat drying may be a dryer, a hot-blast stove, a high-frequency induction furnace, an infrared oven, or the like. When the steel sheet in contact with the chemical conversion solution is heated, the temperature of the steel sheet is preferably 25° C. or higher. It is preferable that, after the steel sheet is kept in contact with the chemical conversion solution for one second or more, the steel sheet is heated at a heating rate of 20° C./s or more. When these conditions are not satisfied, a concentration layer cannot be not fully formed at a coating interface, thereby causing a reduction in corrosion resistance, blackening resistance, or perspiration resistance. In a heating treatment, the attained temperature of the steel sheet is 200° C. or lower and is preferably 180° C. or lower. A heating temperature of higher than 200° C. is not cost-effective and causes defects in a coating to reduce the corrosion resistance.

In embodying aspects of the present invention, the composition of each of the coating bath, the coating film, and the chemical conversion coating can be measured by an approximate method. The composition of the coating bath can be confirmed (measured) in such a manner that, for example, after a portion of the coating bath is taken out, is solidified, is immersed in hydrochloric acid or the like, and is then dissolved therein, the solution is analyzed by ICP emission spectrometry or atomic absorption spectroscopy. The composition of the coating film can be confirmed (measured) in such a manner that, for example, after the coating film is dissolved in hydrochloric acid, the solution is analyzed by ICP emission spectrometry or atomic absorption spectroscopy. The composition of the chemical conversion coating can be confirmed by measuring the intensity of each element by X-ray fluorescence. A crystalline compound present in the chemical conversion coating can be identified by thin-film X-ray diffraction. The composition of the chemical conversion coating only can be identified in such a manner that the intensity of the coated steel sheet provided with no coating film is measured as a background. In a case where a steel sheet provided with no coating film is not obtained, it is difficult to measure the background and therefore another method is used. For example, the following method may be used: a method in which a cross-sectional sample of a steel sheet is prepared; a chemical conversion coating (from the outermost surface of a coating to the outermost surface of the chemical conversion coating) is observed with a scanning electron microscope (SEM), an electron probe microanalyzer (EPMA), a transmission electron microscope (TEM), or the like; and compositional analysis and quantification are performed by energy-dispersive X-ray spectroscopy (EDS) or wavelength-dispersive X-ray spectroscopy (WDS).

EXAMPLES

Hot-dip Zn—Al alloy coated steel sheets were manufactured in a continuous hot-dip coating line using cold-rolled steel sheets, manufactured by a common method, having a thickness of 1.0 mm as base steel sheets under conditions including a target coating weight per side of 70 g/m$^2$ to 80 g/m$^2$ (a target coating weight of 140 g/m$^2$ to 160 g/m$^2$ for both sides).

Chemical conversion solutions were prepared by adding inorganic compounds shown in Table 1 to a bisphenol-A polyurethane resin. Surfaces of the hot-dip Zn—Al alloy coated steel sheets were treated with 60° C. pure water (deionized water), whereby surface stains were removed. Next, after the hot-dip Zn—Al alloy coated steel sheets were washed with water and were dried, each of the hot-dip Zn—Al alloy coated steel sheets was treated with a corresponding one of the chemical conversion solutions. Thereafter, each hot-dip Zn—Al alloy coated steel sheet was intermediately heat-dried for several seconds to ten and several seconds such that the surface temperature of the steel sheet reached a predetermined temperature, whereby a chemical conversion coating was formed and a surface-treated steel sheet was obtained. The thickness of the chemical conversion coating was adjusted to 0.8 μm depending on the solid matter (heating residue) of a coating film composition, the treatment time, or the like. The coating film composition of the hot-dip Zn—Al alloy coated steel sheet, the coating weight (coating weight per side) thereof, and the composition of the chemical conversion coating are shown in Tables 1 and 2.

The composition of a coating film was confirmed (measured) as described below.

<Measurement of Coating Film Composition>

The hot-dip Zn—Al alloy coated steel sheet was punched into a sample with a diameter of 100 mmφ. The sample was immersed in fuming nitric acid, whereby the coating film (a coated layer excluding an interfacial alloy layer) was peeled off. After hydrochloric acid was added to the stripping solution such that Al remaining undissolved was completely dissolved, the solution was analyzed by ICP emission spectrometry, whereby the composition was confirmed (measured). The thickness of the chemical conversion coating was measured in such a manner that the surface-treated steel sheet was cold-cracked and a fracture surface of the coating was measured with a scanning electron microscope (SEM).

The obtained surface-treated steel sheets were evaluated for performance as described below.

<Evaluation of Coating Adhesion Properties>

Each hot-dip Zn—Al alloy coated steel sheet was sheared into a sample with a size of 50 mm×50 mm. The sample was subjected to a Dupont impact test under conditions including an impact diameter of ⅜ inches, a load weight of 1.0 kg, and a drop height of 1,000 mm. After a cellophane tape was tightly attached to an outer surface of a tested projecting part, the cellophane tape was peeled off, followed by rating coating adhesion properties from the condition of the outer surface of the projecting part and the condition of the cellophane tape in accordance with standards below.

Five points (acceptable): No crack or exfoliation is observed.

Four points (acceptable): A fine crack is observed and no exfoliation is observed.

Three points (acceptable): A crack is observed and no exfoliation is observed.

Two points (unacceptable): Slight exfoliation is observed.

One point(unacceptable): Significant exfoliation is observed.

<Evaluation of End Part Corrosion Resistance>

A sample was prepared in such a manner that, after each surface-treated steel sheet was sheared to a size of 70 mm (top and bottom sides)×150 mm (right and left sides), 10-mm end parts on the top and bottom sides of an evaluation surface and a non-evaluation surface (back surface) were sealed with a tape and 150-mm sheared end parts on the right and left sides were exposed. Salt spray testing (SST): JIS Z 2371 was performed for 480 hours using the evaluation sample (the FIGURE), the length (the maximum corrosion width from an end part) of rust on a coating surface that proceeds from a sheared end part was measured, and the end part corrosion resistance was evaluated in accordance with standards below.

A: A maximum corrosion width of 20 mm or less.

B: A maximum corrosion width of 25 mm or less.

C: A maximum corrosion width of more than 25 mm.

Results are shown in Tables 1 and 2.

TABLE 1

| | Coating film | | | | | | | | | Chemical conversion coating | | | | | | | | | |
|---|---|---|---|---|---|---|---|---|---|---|---|---|---|---|---|---|---|---|---|
| | Composition (mass %) | | | | | | | | Coating weight per side ($g/m^2$) | Inorganic Compound (1) | | Inorganic Compound (2) | | Inorganic Compound (3) | | Coating adhesion properties | End part corrosion resistance | Remarks |
| No. | Zn | Al | Mg | Si | Ca | Ti | Cr | Ni | | Inorganic compound | Content (mass %) | Inorganic compound | Content (mass %) | Inorganic compound | Content (mass %) | | | |
| 1 | Balance | 0.2 | — | — | — | — | — | — | 70 | $AlH_2P_3O_{10}\bullet 2H_2O$ | 45 | MgO | 5.0 | — | — | 5 | C | Comparative example |
| 2 | Balance | 1.1 | — | — | — | — | — | — | 75 | $Zn_3(PO_4)_2$ | 45 | MgO | 5.0 | — | — | 5 | C | Comparative example |
| 3 | Balance | 1.1 | — | — | — | — | — | — | 71 | $Zn_3(PO_4)_2$ | 46 | MgO | 2.0 | $SiO_2$ | 1.0 | 5 | C | Comparative example |
| 4 | Balance | 1.1 | — | — | — | — | — | — | 75 | $Zn_3(PO_4)_2$ | 44 | $SiO_2$ | 5.0 | — | — | 5 | C | Comparative example |
| 5 | Balance | 1.1 | — | — | — | — | — | — | 71 | $AlH_2P_3O_{10}\bullet 2H_2O$ | 50 | — | — | — | — | 5 | C | Comparative example |
| 6 | Balance | 1.1 | — | — | — | — | — | — | 76 | $AlH_2P_3O_{10}\bullet 2H_2O$ | 45 | MgO | 5.0 | — | — | 5 | B | Inventive example |
| 7 | Balance | 1.1 | 0.1 | — | — | — | — | — | 74 | $AlH_2P_3O_{10}\bullet 2H_2O$ | 45 | MgO | 5.0 | — | — | 5 | B | Inventive example |
| 8 | Balance | 5.2 | — | — | — | — | — | — | 75 | — | — | — | — | — | — | 4 | C | Comparative example |
| 9 | Balance | 5.2 | — | — | — | — | — | — | 75 | $AlH_2P_3O_{10}\bullet 2H_2O$ | 3 | — | — | — | — | 4 | C | Comparative example |
| 10 | Balance | 5.2 | — | — | — | — | — | — | 72 | $AlH_2P_3O_{10}\bullet 2H_2O$ | 2.5 | MgO | 0.5 | — | — | 4 | B | Inventive example |
| 11 | Balance | 5.2 | — | — | — | — | — | — | 75 | $AlH_2P_3O_{10}\bullet 2H_2O$ | 30 | $MgZn_2$ | 2.0 | — | — | 4 | B | Inventive example |
| 12 | Balance | 5.2 | — | — | — | — | — | — | 70 | $AlH_2P_3O_{10}\bullet 2H_2O$ | 30 | MgO | 3.0 | $SiO_2$ | 1.0 | 4 | B | Inventive example |
| 13 | Balance | 5.2 | — | — | — | — | — | — | 75 | $AlH_2P_3O_{10}\bullet 2H_2O$ | 40 | $MgAl_2O_4$ | 5.0 | — | — | 4 | A | Inventive example |
| 14 | Balance | 4.8 | 4.5 | — | — | — | — | — | 72 | $AlH_2P_3O_{10}\bullet 2H_2O$ | 35 | MgO | 5.0 | — | — | 4 | A | Inventive example |
| 15 | Balance | 4.5 | 1.0 | — | — | — | — | 0.02 | 75 | $AlH_2P_3O_{10}\bullet 2H_2O$ | 35 | MgO | 5.0 | — | — | 5 | A | Inventive example |
| 16 | Balance | 4.5 | 0.8 | 0.01 | — | — | — | — | 76 | $AlH_2P_3O_{10}\bullet 2H_2O$ | 35 | $Mg(NO_3)_2\bullet 6H_2O$ | 5.0 | — | — | 5 | B | Inventive example |
| 17 | Balance | 6.1 | 3.5 | — | 0.5 | — | — | — | 75 | $AlH_2P_3O_{10}\bullet 2H_2O$ | 40 | MgO | 3.0 | — | — | 3 | A | Inventive example |
| 18 | Balance | 9.0 | 3.2 | — | — | — | 0.1 | — | 78 | $AlH_2P_3O_{10}\bullet 2H_2O$ | 40 | MgO | 2.0 | $SiO_2$ | 2.0 | 5 | B | Inventive example |
| 19 | Balance | 10.4 | 1.6 | — | — | 0.1 | — | 0.01 | 75 | $AlH_2P_3O_{10}\bullet 2H_2O$ | 25 | MgO | 5.0 | — | — | 5 | A | Inventive example |
| 20 | Balance | 13.1 | 9.8 | — | — | — | — | — | 74 | $AlH_2P_3O_{10}\bullet 2H_2O$ | 25 | $MgSO_4\bullet 7H_2O$ | 5.0 | — | — | 3 | B | Inventive example |
| 21 | Balance | 14.8 | 9.8 | 0.2 | 9.6 | — | — | — | 72 | $AlH_2P_3O_{10}\bullet 2H_2O$ | 25 | MgO | 5.0 | — | — | 4 | B | Inventive example |
| 22 | Balance | 15.6 | 3.0 | — | — | — | — | — | 75 | $AlH_2P_3O_{10}\bullet 2H_2O$ | 25 | MgO | 2.0 | — | — | 2 | B | Comparative example |
| 23 | Balance | 17.2 | 3.2 | — | — | — | — | — | 75 | $AlH_2P_3O_{10}\bullet 2H_2O$ | 25 | MgO | 5.0 | — | — | 1 | B | Comparative example |
| 24 | Balance | 5.5 | — | — | — | — | — | — | 73 | $AlH_2P_3O_{10}\bullet 2H_2O$ | 2.5 | MgO | 0.1 | — | — | 4 | C | Comparative example |
| 25 | Balance | 5.5 | — | — | — | — | — | — | 73 | $AlH_2P_3O_{10}\bullet 2H_2O$ | 25 | $ZrO_2$ | 5.0 | — | — | 4 | C | Comparative example |
| 26 | Balance | 5.5 | — | — | — | — | — | — | 74 | $AlH_2P_3O_{10}\bullet 2H_2O$ | 25 | $SiO_2$ | 5.0 | — | — | 4 | C | Comparative example |
| 27 | Balance | 5.5 | — | — | — | — | — | — | 73 | $AlH_2P_3O_{10}\bullet 2H_2O$ | 25 | $Al_2O_3$ | 5.0 | — | — | 4 | C | Comparative example |
| 28 | Balance | 5.5 | — | — | — | — | — | — | 74 | $AlH_2P_3O_{10}\bullet 2H_2O$ | 25 | $Cr_2O_3$ | 5.0 | — | — | 4 | C | Comparative example |
| 29 | Balance | 5.5 | — | — | — | — | — | — | 73 | $AlH_2P_3O_{10}\bullet 2H_2O$ | 25 | Fe—Cr (SUS-430L) | 5.0 | — | — | 4 | C | Comparative example |

TABLE 2

| | Coating film | | | | | | | | | Chemical conversion coating |
|---|---|---|---|---|---|---|---|---|---|---|
| | Composition (mass %) | | | | | | | | Coating weight per | Inorganic Compound (1) Inorganic |
| No. | Zn | Al | Mg | Si | Ca | Ti | Cr | Ni | side ($g/m^2$) | compound |
| 1 | Balance | 1.1 | — | — | — | — | — | — | 75 | $Zn_3(PO_4)_2$ |
| 2 | Balance | 1.1 | — | — | — | — | — | — | 72 | $Zn_3(PO_4)_2$ |
| 3 | Balance | 1.1 | — | — | — | — | — | — | 74 | $Zn_3(PO_4)_2$ |
| 4 | Balance | 1.1 | — | — | — | — | — | — | 75 | $AlH_2P_3O_{10}\bullet 2H_2O$ |
| 5 | Balance | 1.1 | — | — | — | — | — | — | 76 | $AlH_2P_3O_{10}\bullet 2H_2O$ |
| 6 | Balance | 1.1 | 0.1 | — | — | — | — | — | 74 | $AlH_2P_3O_{10}\bullet 2H_2O$ |
| 7 | Balance | 5.2 | — | — | — | — | — | — | 80 | — |
| 8 | Balance | 5.2 | — | — | — | — | — | — | 75 | $AlH_2P_3O_{10}\bullet 2H_2O$ |
| 9 | Balance | 5.2 | — | — | — | — | — | — | 72 | $AlH_2P_3O_{10}\bullet 2H_2O$ |
| 10 | Balance | 5.2 | — | — | — | — | — | — | 76 | $AlH_2P_3O_{10}\bullet 2H_2O$ |
| 11 | Balance | 5.2 | — | — | — | — | — | — | 74 | $AlH_2P_3O_{10}\bullet 2H_2O$ |
| 12 | Balance | 5.2 | — | — | — | — | — | — | 75 | $AlH_2P_3O_{10}\bullet 2H_2O$ |
| 13 | Balance | 4.8 | 4.5 | — | — | — | — | — | 71 | $AlH_2P_3O_{10}\bullet 2H_2O$ |
| 14 | Balance | 4.5 | 1.0 | — | — | — | — | 0.02 | 75 | $AlH_2P_3O_{10}\bullet 2H_2O$ |
| 15 | Balance | 4.5 | 0.8 | 0.01 | — | — | — | — | 75 | $AlH_2P_3O_{10}\bullet 2H_2O$ |
| 16 | Balance | 6.1 | 3.5 | — | 0.5 | — | — | — | 70 | $AlH_2P_3O_{10}\bullet 2H_2O$ |
| 17 | Balance | 9.0 | 3.2 | — | — | — | 0.1 | — | 75 | $AlH_2P_3O_{10}\bullet 2H_2O$ |
| 18 | Balance | 10.4 | 1.6 | — | — | 0.1 | — | 0.01 | 75 | $AlH_2P_3O_{10}\bullet 2H_2O$ |
| 19 | Balance | 13.1 | 9.8 | — | — | — | — | — | 70 | $AlH_2P_3O_{10}\bullet 2H_2O$ |
| 20 | Balance | 14.8 | 9.8 | 0.2 | 9.6 | — | — | — | 72 | $AlH_2P_3O_{10}\bullet 2H_2O$ |

| | Chemical conversion coating | | | | | | | |
|---|---|---|---|---|---|---|---|---|
| | Inorganic Compound (1) | Inorganic Compound (2) | | Inorganic Compound (3) | | Coating | End part | |
| No. | Content (mass %) | Inorganic compound | Content (mass %) | Inorganic compound | Content (mass %) | adhesion properties | corrosion resistance | Remarks |
| 1 | 45 | CaO | 5 | — | — | 5 | C | Comparative example |
| 2 | 46 | CaO | 2 | $SiO_2$ | 1 | 5 | C | Comparative example |
| 3 | 44 | $SiO_2$ | 5 | — | — | 5 | C | Comparative example |
| 4 | 50 | — | — | — | — | 5 | C | Comparative example |
| 5 | 45 | SrO | 5 | — | — | 5 | A | Inventive example |
| 6 | 45 | CaO | 5 | — | — | 5 | A | Inventive example |
| 7 | — | — | — | — | — | 4 | C | Comparative example |
| 8 | 3 | — | — | — | — | 4 | C | Comparative example |
| 9 | 2.5 | CaO | 0.5 | — | — | 4 | B | Inventive example |
| 10 | 30 | $CaCO_3$ | 2 | — | — | 4 | B | Inventive example |
| 11 | 30 | CaO | 3 | $SiO_2$ | 1 | 4 | A | Inventive example |
| 12 | 40 | $Ca(OH)_2$ | 5 | — | — | 4 | B | Inventive example |
| 13 | 35 | SrO | 5 | — | — | 4 | A | Inventive example |
| 14 | 35 | CaO | 4 | SrO | 1 | 5 | A | Inventive example |
| 15 | 35 | $Ca(NO_3)_2\bullet 4H_2O$ | 5 | — | — | 5 | B | Inventive example |
| 16 | 40 | CaO | 3 | — | — | 4 | A | Inventive example |
| 17 | 40 | SrO | 2 | $SiO_2$ | 2 | 5 | B | Inventive example |
| 18 | 25 | CaO | 5 | — | — | 5 | A | Inventive example |
| 19 | 25 | $CaSO_4\bullet 2H_2O$ | 5 | — | — | 3 | B | Inventive example |
| 20 | 25 | CaO | 5 | — | — | 4 | B | Inventive example |

According to Tables 1 and 2, it is clear that surface-treated steel sheets each including a chemical conversion coating, formed on a surface of a hot-dip Al—Zn alloy coated steel sheet, containing $AlH_2P_3O_{10}.2H_2O$ and a compound containing one or more elements selected from Mg, Ca, and Sr in combination exhibit excellent end part corrosion resistance.

The invention claimed is:

1. A surface-treated steel sheet comprising a chemical conversion coating with a thickness of 0.1 μm or more and 1.0 μm or less, the chemical conversion coating being placed on a surface of a hot-dip Zn—Al alloy coated steel sheet including a hot-dip Zn—Al alloy coating film containing Al: more than 1.0 mass % and 15 mass % or less, a balance being Zn and inevitable impurities, wherein the chemical conversion coating contains $AlH_2P_3O_{10}.2H_2O$ and a compound containing one or more elements selected from Mg and Sr such that a sum of contents of $AlH_2P_3O_{10}.2H_2O$ and the compound is 3.0 mass % to 50 mass %, and wherein the hot-dip Zn—Al alloy coating film further contains at least one selected from groups A and B group A: Mg: 0.1 mass to 10 mass %; and group B: one or more elements selected from Si, Ca, Ti, Cr, and Ni such that a sum of contents of the elements is 0.01 mass % to 1.0 mass %.

2. The surface-treated steel sheet according to claim 1, wherein the compound containing one or more elements selected from Mg and Sr is one or more oxides selected from MgO, $MgAl_2O_4$ and SrO.

3. The surface-treated steel sheet according to claim 1, wherein the chemical conversion coating further contains $SiO_2$ and a sum of contents of the $SiO_2$; the compound containing one or more elements selected from Mg and Sr; and the $AlH_2P_3O_{10}.2H_2O$ is 3.0 mass % to 50 mass %.

4. The surface-treated steel sheet according to claim 2, wherein the chemical conversion coating further contains $SiO_2$ and a sum of contents of the $SiO_2$; the compound containing one or more elements selected from Mg and Sr; and the $AlH_2P_3O_{10}.2H_2O$ is 3.0 mass % to 50 mass %.

5. The surface-treated steel sheet according to claim 1, wherein the surface-treated steel sheet has a maximum corrosion width of 20 mm or less, upon performing a salt spray test according to JIS Z 2371.

6. The surface-treated steel sheet according to claim 1, wherein when a portion of the surface-treated steel sheet corrodes, a passivation film is formed to suppress the progress of subsequent corrosion by chelating $P_3O_{10}^{5}$ *from the chemical conversion coating with* $Al^{3+}$, $Zn^{2+}$, $Fe^{2+}$, *and* $Fe^{3+}$ *from the hot-dip Zn—Al alloy coated steel sheet.*

* * * * *